US011351784B2

(12) United States Patent
Murata

(10) Patent No.: US 11,351,784 B2
(45) Date of Patent: Jun. 7, 2022

(54) LIQUID DROPLET EJECTION DEVICE AND LIQUID DROPLET EJECTION METHOD

(71) Applicant: SIJTechnology, Inc., Tsukuba (JP)

(72) Inventor: Kazuhiro Murata, Tsukuba (JP)

(73) Assignee: SIJTECHNOLOGY, INC., Tsukuba (JP)

( * ) Notice: Subject to any disclaimer, the term of this patent is extended or adjusted under 35 U.S.C. 154(b) by 0 days.

(21) Appl. No.: 17/100,193

(22) Filed: Nov. 20, 2020

(65) Prior Publication Data

US 2021/0070047 A1 Mar. 11, 2021

Related U.S. Application Data

(63) Continuation of application No. PCT/JP2020/010369, filed on Mar. 10, 2020.

(30) Foreign Application Priority Data

Apr. 25, 2019 (JP) ..... JP2019-084650

(51) Int. Cl.
*B41J 2/14* (2006.01)
*B41J 2/045* (2006.01)

(52) U.S. Cl.
CPC ..... *B41J 2/14314* (2013.01); *B41J 2/04576* (2013.01); *B41J 2/04581* (2013.01); *B41J 2/14201* (2013.01)

(58) Field of Classification Search
CPC ..... B41J 2/14314; B41J 2/04576; B41J 2/04581; B41J 2/14201; B41J 2/01;
(Continued)

(56) References Cited

U.S. PATENT DOCUMENTS

2004/0021738 A1 2/2004 Suganuma
2006/0017782 A1 1/2006 Nishi et al.
(Continued)

FOREIGN PATENT DOCUMENTS

CN 1476975 A 2/2004
CN 1684834 A 10/2005
(Continued)

OTHER PUBLICATIONS

International Search Report received from the Japan Patent Office in International Application No. PCT/JP2020/010369 dated May 26, 2020.

(Continued)

*Primary Examiner* — Kristal Feggins
(74) *Attorney, Agent, or Firm* — The Marbury Law Group, PLLC

(57) ABSTRACT

A liquid droplet ejection device includes at least one first liquid droplet ejection unit including a first liquid holding unit and a first tip, the first tip to eject the first liquid in the first liquid holding unit as a first liquid droplet onto an object; at least one second liquid droplet ejection unit including a second liquid holding unit and a second tip, the second tip to eject the second liquid in the second liquid holding unit as a second liquid droplet onto the object; an object holding unit to hold the object; and a driving unit to move the first tip and the second tip in a first direction. An inner diameter of the second tip is larger than an inner diameter of the first tip. The first tip and the second tip are arranged along the first direction. The second tip is arranged behind the first tip.

9 Claims, 12 Drawing Sheets

(58) Field of Classification Search
CPC ..... B41J 2/14; B05D 1/26; B05D 1/36; B05C 9/06; B05C 5/00
See application file for complete search history.

(56) References Cited

U.S. PATENT DOCUMENTS

| | | | |
|---|---|---|---|
| 2006/0223316 | A1 | 10/2006 | Baik et al. |
| 2006/0262163 | A1 | 11/2006 | Nishio et al. |
| 2008/0165225 | A1 | 7/2008 | Kitahara et al. |
| 2010/0194800 | A1 | 8/2010 | Hong et al. |
| 2010/0209614 | A1 | 8/2010 | Sakata et al. |
| 2018/0040750 | A1 | 2/2018 | Bower et al. |

FOREIGN PATENT DOCUMENTS

| | | | |
|---|---|---|---|
| CN | 101219599 | A | 7/2008 |
| CN | 101428497 | A | 5/2009 |
| CN | 101791903 | A | 8/2010 |
| JP | H10-34967 | A | 2/1998 |
| JP | 2004-114380 | A | 4/2004 |
| JP | 2008-213221 | A | 9/2008 |
| JP | 2010-188264 | A | 9/2010 |
| JP | 2010-240536 | A | 10/2010 |
| JP | 2013-086447 | A | 5/2013 |
| JP | 2016-210184 | A | 12/2016 |
| KR | 10-2006-0105111 | A | 10/2006 |
| KR | 10-2015-0144257 | A | 12/2015 |
| KR | 10-2016-0080452 | A | 7/2016 |
| WO | 2009/057464 | A1 | 5/2009 |
| WO | 2010/028712 | A1 | 3/2010 |
| WO | 2016/124814 | A1 | 8/2016 |

OTHER PUBLICATIONS

International Search Authority received from the Japan Patent Office in International Application No. PCT/JP2020/010369 dated May 26, 2020.

International Search Report received in International Application No. PCT/JP2020/010369 dated Jun. 2, 2020.

First Notification of Office Action received in Chinese Application No. 202080003001.5. dated Aug. 27, 2021.

Written Opinion of the International Searching Authority received in International Application No. PCT/JP2020/010369 dated Jun. 2, 2020.

Office Action in related Korean Patent Application No. 10-2020-7032373 dated Dec. 26, 2021.

Office Action in related Korean Patent Application No. 10-2020-7032371 dated Dec. 26, 2021.

LIQUID DROPLET EJECTION DEVICE AND LIQUID DROPLET EJECTION METHOD

CROSS REFERENCE TO RELATED APPLICATIONS

This application is a continuation application (bypass route) based upon PCT/JP2020/010369 filed on Mar. 10, 2020 and claims the benefit of priority to Japanese Patent Application No. 2019-084650 filed on Apr. 25, 2019, the entire contents of both which are incorporated herein by reference.

FIELD

The present disclosure relates to a liquid droplet ejection device and a liquid droplet ejection method.

BACKGROUND

In recent years, inkjet printing technology has been applied to industrial processes. For example, a color filter manufacturing process for a liquid crystal display is an example. As an inkjet printing technique, a so-called piezo-type inkjet head that ejects a liquid droplet by conventional mechanical pressure or vibration is used.

While the printing technique using the piezo inkjet head is a mature technique, it is difficult to control landing accuracy, and the size of liquid droplets that can be formed, and the like. For example, an inkjet with a liquid droplet volume of 4 pico-liter has a liquid droplet diameter of about 20 μm, and it is difficult to correspond to the pixel formation of a QD (quantum dot) display with a pitch of several micrometers.

Therefore, an electrostatic type inkjet head capable of ejecting finer a liquid droplet is drawing attention. Japanese Unexamined Patent Application Publication No. H10-34967 discloses an electrostatic ejection type inkjet recording device.

SUMMARY

According to an embodiment of the present disclosure, a liquid droplet ejection device includes at least one first liquid droplet ejection unit including a first liquid holding unit and a first tip, the first liquid holding unit being configured to hold a first liquid, and the first tip being configured to eject the first liquid in the first liquid holding unit as a first liquid droplet onto an object; at least one second liquid droplet ejection unit including a second liquid holding unit and a second tip, the second liquid holding unit being configured to hold a second liquid, and the second tip being configured to eject the second liquid in the second liquid holding unit as a second liquid droplet having different characteristics from the first liquid droplet onto the object; an object holding unit configured to hold the object onto which the first liquid and the second liquid are ejected; and a driving unit configured to move the first tip and the second tip in a first direction relative to the object holding unit. An inner diameter of the second tip is larger than an inner diameter of the first tip. The first tip and the second tip are arranged along the first direction. The second tip is arranged behind the first tip.

In the liquid droplet ejection device, an ejection amount of the second liquid droplet by the second liquid droplet ejection unit per unit time may be more than an ejection amount of the first liquid droplet by the first liquid droplet ejection unit per unit time.

In the liquid droplet ejection device, the first liquid droplet ejection unit may have an electrostatic ejection type nozzle head, and the second liquid droplet ejection unit may have a piezo type nozzle head.

In the liquid droplet ejection device, the first liquid droplet ejection unit may include a plurality of first liquid droplet ejection units provided in the direction intersecting the first direction, and the second liquid droplet ejection unit may include a plurality of second liquid droplet ejection units provided in the direction intersecting the first direction.

According to an embodiment of a present disclosure, a liquid droplet ejection method includes ejecting a first liquid droplet onto a first region of an object, ejecting a second liquid droplet having different characteristics from the first liquid droplet with ejection amount more than ejection amount of the first liquid droplet onto the first region so as to be contacted with the ejected first liquid droplet, and ejecting the first liquid droplet onto a second region different from the first region in synchronization with ejecting the second liquid droplet into the first region.

In the liquid droplet ejection method, a part of the first liquid droplet may be fixed to the object before the second ejected droplet is ejected.

In the liquid droplet ejection method, a size of the ejected first liquid droplet may be 100 nm or more and 500 μm or less.

In the liquid droplet ejection method, a solvent of the first liquid droplet and a solvent of the second liquid droplet may be the same kind of liquid.

In the liquid droplet ejection method, the first liquid droplet may do not include particles, and the second liquid droplet may include particles.

In the liquid droplet ejection method, a structure may be provided on the object so as to surround each of the first region and the second region of the object, a surface of the object may have a lipophilic property, and a surface of the structure may have liquid repellent property.

By using an embodiment of the present disclosure, it is possible to eject liquid droplets at high processing speed while improving positional accuracy.

DESCRIPTION OF EMBODIMENTS

Figure 1:
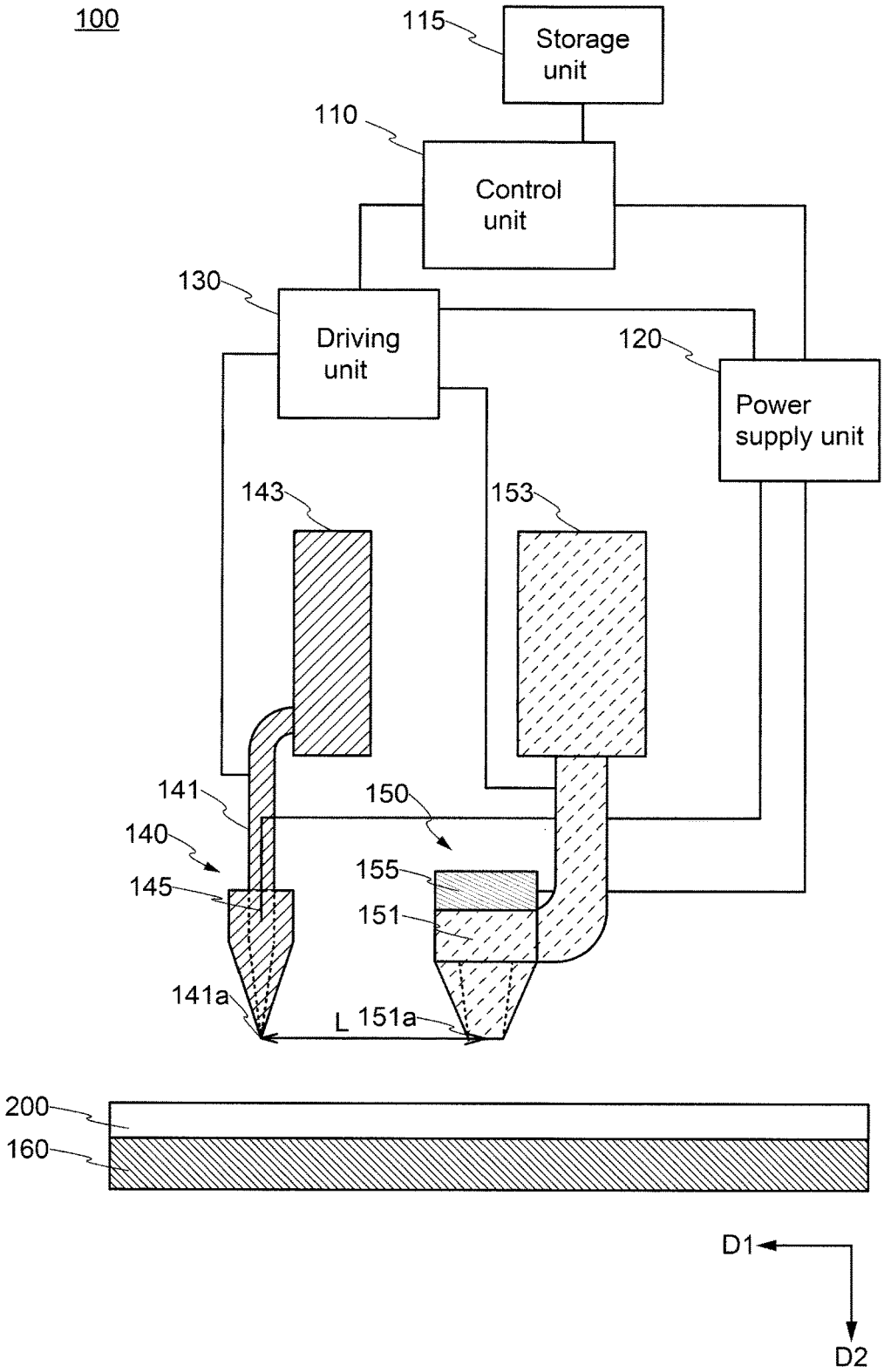
FIG. 1 is a schematic view of a liquid droplet ejection device according to an embodiment of the present disclosure.

Hereinafter, embodiments of the present disclosure disclosed in the present application will be described with reference to the drawings. However, the present disclosure can be implemented in various forms without departing from the gist thereof, and should not be construed as being limited to the description of the following exemplary embodiments.

In the drawings referred to in the present exemplary embodiments, the same portions or portions having similar functions are denoted by the identical signs or similar signs (signs each formed simply by adding A, B, etc. to the end of a number), and a repetitive description thereof may be omitted. For the convenience of description, the dimensional ratio of the drawings may be different from the actual ratio, or a part of the configuration may be omitted from the drawings.

Furthermore, in the detailed description of the present disclosure, when defining the positional relationship between one component and another, the terms "above" and "below" include not only the case of being positioned directly above or below one component, but also the case of interposing another component therebetween, unless otherwise specified.

In the case of the inkjet system of electrostatic ejection type, although it has excellent controllability for accuracy and eject volume, it is difficult to eject the large liquid droplet. Therefore, the electrostatic ejection type inkjet method has a problem in terms of shortening the processing time. When handling particulate-containing materials in the electrostatic ejection type inkjet, there is a risk of nozzle clogging due to dryness.

One of objects of the present disclosure is to provide a liquid droplet eject technique having a high throughput while improving positional accuracy.

First Embodiment

1-1. Configuration of Liquid Droplet Ejection Device 100

FIG. 1 is a schematic view of a liquid droplet ejection device 100 according to an embodiment of the present disclosure.

The liquid droplet ejection device 100 includes a control unit 110, a storage unit 115, a power supply unit 120, a driving unit 130, a first liquid droplet ejection unit 140, a second liquid droplet ejection unit 150, and an object holding unit 160.

The control unit 110 includes CPU (Central Processing Unit), ASIC (Application Specific Integrated Circuit), FPGA (Field Programmable Gate Array), or other calculation processing circuitry. The control unit 110 controls the ejection processes performed by the first liquid droplet ejection unit 140 and the second liquid droplet ejection unit 150 by using preset droplet ejection programs.

The control unit 110 controls an ejection timing of a first liquid droplet 147 (see FIG. 3) from the first liquid droplet ejection unit 140 and an ejection timing of the second liquid droplet 157 (see FIG. 5) from the second liquid droplet ejection unit 150. As described in detail later, the ejection of the first liquid droplet 147 by the first liquid droplet ejection unit 140 and the ejection of the second liquid droplet 157 by the second liquid droplet ejection unit 150 are synchronized with each other. "Synchronizing" in the present embodiment means that the first liquid droplet and the second liquid droplet are ejected at a constant cycle. In this example, the first liquid droplet 147 and the second liquid droplet 157 are ejected simultaneously. The control unit 110 controls the second liquid droplet ejection unit 150 to move to the first region and eject the second liquid droplet 157 when the first liquid droplet ejection unit 140 moves from first region to second region of the object 200, on which the first liquid droplet 147 is ejected.

The storage unit 115 has a function as a database for storing a liquid droplet ejecting program and various types of data used in the liquid droplet ejecting program. Memory, SSD (Solid State Drive), or storable element are used for the storage unit 115.

The power supply unit 120 is connected to the control unit 110, the driving unit 130, the first liquid droplet ejection unit 140, and the second liquid droplet ejection unit 150. The power supply unit 120 applies a voltage to the first liquid droplet ejection unit 140 and the second liquid droplet ejection unit 150 based on a signal input from the control unit 110. In this example, the power supply unit 120 applies a pulsed voltage to the first liquid droplet ejection unit 140. The voltage is not limited to the pulse voltage, and a constant voltage may be applied at all times.

The driving unit 130 includes a driving member such as a motor, a belt, and a gear. Based on an instruction from the control unit 110, the driving unit 130 moves the first liquid droplet ejection unit 140 and the second liquid droplet ejection unit 150 to predetermined positions on the object 200.

The first liquid droplet ejection unit 140 includes a first liquid droplet nozzle 141 and a first ink tank 143 (also referred to as a first liquid holding unit). The electrostatic ejection type inkjet nozzle is used as the first liquid droplet nozzle 141. An inner diameter of nozzle tip 141*a* in the first liquid droplet nozzle 141 is 100 nm or more and 30 μm or less, preferably 0.5 μm or more and 20 μm or less, more preferably 1.5 μm or more and 10 μm or less.

The second liquid droplet nozzle 141 has a glass tube, and an electrode 145 is provided inside the glass tube. In this example, a fine wire formed of tungsten is used as the electrode 145. The electrode 145 is not limited to tungsten, and the electrode 145 may be formed of nickel, molybdenum, titanium, gold, silver, copper, platinum, or the like.

The electrode 145 in the first liquid droplet nozzle 141 is electrically connected to the power supply unit 120. The first liquid held in the first ink tank 143 is ejected as a first liquid droplet 147 from the nozzle tip 141*a* (also referred to as a first tip) of the first liquid droplet nozzle 141 by a voltage (in this example, 1000V) applied from the power supply unit 120 to the inside of the first liquid droplet nozzle 141 and the electrode 145. By controlling the voltage applied from the power supply unit 120, the shapes of the liquid droplet (patterns) formed by the first liquid droplet 147 can be controlled.

The second liquid droplet ejection unit 150 includes a second liquid droplet nozzle 151 and a second ink tank 153. In this embodiment, a piezo type inkjet nozzle is used as the second liquid droplet nozzle 151. A piezoelectric element 155 is provided on the top of the second liquid droplet nozzle 151. The piezoelectric element 155 is electrically connected to the power supply unit 120. The piezoelectric element 155 presses the second liquid by the voltage applied from the power supply unit 120. As a result, the second liquid held in the second ink tank 153 is ejected as the second liquid droplet 157 from the nozzle tip 151*a* of the second liquid droplet nozzle 151.

The second liquid droplet nozzle 151 of the second liquid droplet ejection unit 150 is provided perpendicularly to the surface of the object 200.

An inner diameter of the nozzle tip 151*a* in the second liquid droplet nozzle 151 is desirably larger than an inner diameter of the nozzle tip 141*a* in the first liquid droplet nozzle 141. As a result, a second ejection amount per unit time by the second liquid droplet ejection unit 150 can be greater than a first ejection amount per unit time by the first droplet ejection unit 140.

The object holding unit 160 has a function of holding the object 200. For the object holding unit 160, a stage is used in this instance. The mechanism by which the object holding unit 160 holds the object 200 is not particularly limited, and a common holding mechanism is used. In this example, the object 200 is vacuum-adsorbed to the object holding unit 160. In addition, it is not limited thereto, and the object holding unit 160 may hold the object 200 using a fixture.

The first liquid droplet ejection unit 140 and the second liquid droplet ejection unit 150 are arranged along a direction in which the first liquid droplet ejection unit 140 and the second liquid droplet ejection unit 150 move relative to the object holding unit 160 (in this example, the first direction (the direction D1)). Specifically, the second liquid droplet ejection unit 150 (more specifically, the nozzle tip 151*a* of the second liquid droplet nozzle 151) is arranged behind the first liquid droplet ejection unit 140 (more specifically, the nozzle tip 141*a* of the first liquid droplet nozzle 141) in the direction D1. The distances L between the first liquid droplet ejection unit 140 and the second liquid droplet ejection unit 150 can be appropriately adjusted.

1-2. Liquid Droplet Ejection Method

Next, a liquid droplet ejection method is described with reference to the drawings.

Figure 2:
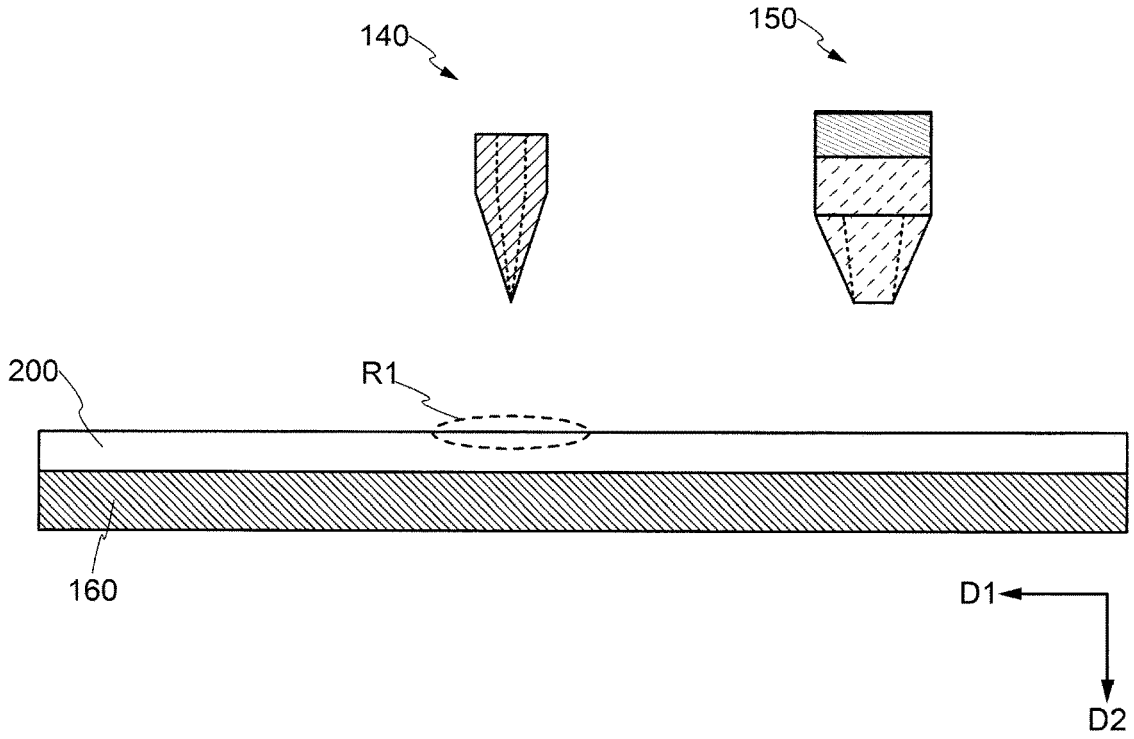
FIG. 2 is a cross-sectional view of a liquid droplet ejection method according to an embodiment of the present disclosure.

First, the first liquid droplet ejection unit 140 and the second control unit 150 move onto the object 200 prepared in the liquid droplet ejection device 100 by the control unit 110 and the driving unit 130. In this case, as shown in FIG. 2, the first droplet ejection unit 140 is arranged on the first region R1 of the object 200 at a certain distance from the surface of the first region R1.

The object 200 refers to a member in which the first liquid droplet 147 and the second liquid droplet 157 are ejected. In this embodiment, a flat glass plate is used for the object 200. The object 200 is not limited to the flat glass plate. For example, the object 200 may be a metallic plate or an organic member. The object 200 may include a counter electrode for the liquid droplet ejection appropriately.

Figure 3:
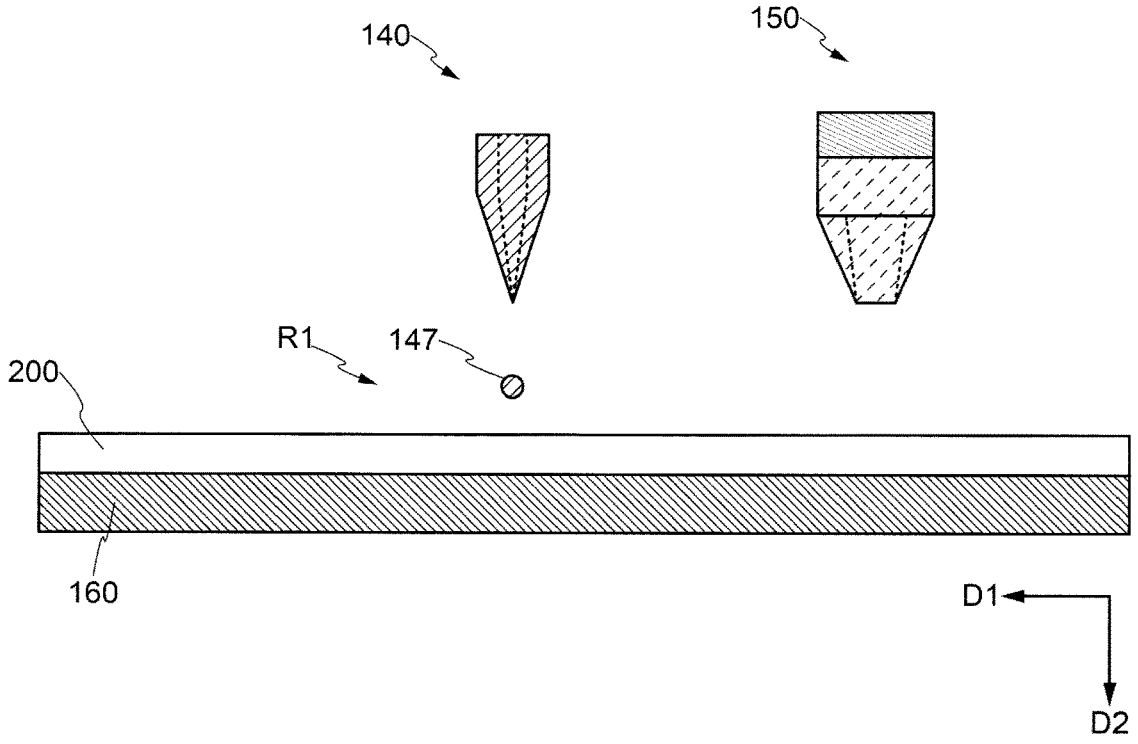
FIG. 3 is a cross-sectional view of a liquid droplet ejection method according to an embodiment of the present disclosure.

Next, as shown in FIG. 3, the first liquid droplet ejection unit 140 ejects the first liquid droplet 147 onto the first region R1 in the direction D2.

A particle-free liquid material is used for the first droplet 147. Specifically, organic solvents which do not include particles such as pigments are used. Because the first liquid droplet 147 does not include particles, clogging of nozzle tip 141*a* in the first liquid droplet ejection unit 140 is suppressed. Therefore, the ejection failure from the first liquid droplet ejection unit 140 can be suppressed.

Since the first liquid droplet ejection unit 140 includes an electrostatic ejection type inkjet, the ejection amount is controlled by a voltage applied from the power supply unit 120. The ejection amount of the first liquid droplet 147 is preferably 0.1 fl or more and 100 pl or less, preferably 0.1 fl or more and 10 pl or less, and more preferably 0.3 fl or more and 1 pl or less. In this case, it is desirable that the size of the first liquid droplet 147 landed on the object 200 is 100 nm or more and 500 μm or less.

It is desirable that a portion of the first liquid droplet 147 ejected on the object 200 is fixed to the object 200 prior to eject the second liquid droplet 157. In this case, it is desirable to perform a pinning process on the first liquid droplet 147. It is preferable to apply a light-irradiation treatment for the pinning process. The wavelength of the irradiated light is appropriately adjusted according to the material to be ejected.

Figure 4:
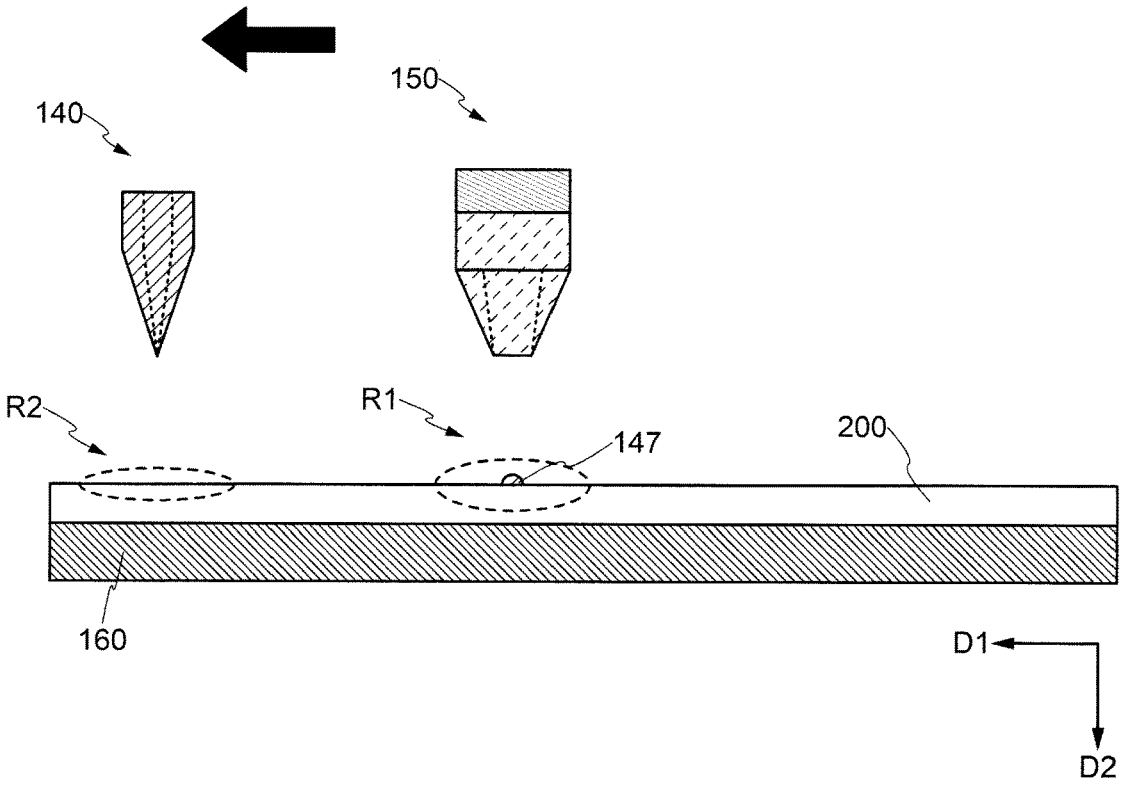
FIG. 4 is a cross-sectional view of a liquid droplet ejection method according to an embodiment of the present disclosure.

Next, as shown in FIG. 4, the first liquid droplet ejection unit 140 moves from the first region R1 to a second region R2 on the object 200. The second liquid droplet ejection unit 150 moves onto the first region R1 on which the first liquid droplet 147 is ejected in accordance with the movement of the first liquid droplet ejection unit 140. In this case, it can be said that the first liquid droplet ejection unit 140 and the second liquid droplet ejection unit 150 move in the direction D1. The moving speeds of the first liquid droplet ejection unit 140 and the second liquid droplet ejection unit 150 are desirably set in advance considering drying time of the first liquid droplet 147, distance L between the first liquid droplet ejection unit 140 and the second liquid droplet ejection unit 150, and the like.

Figure 5:
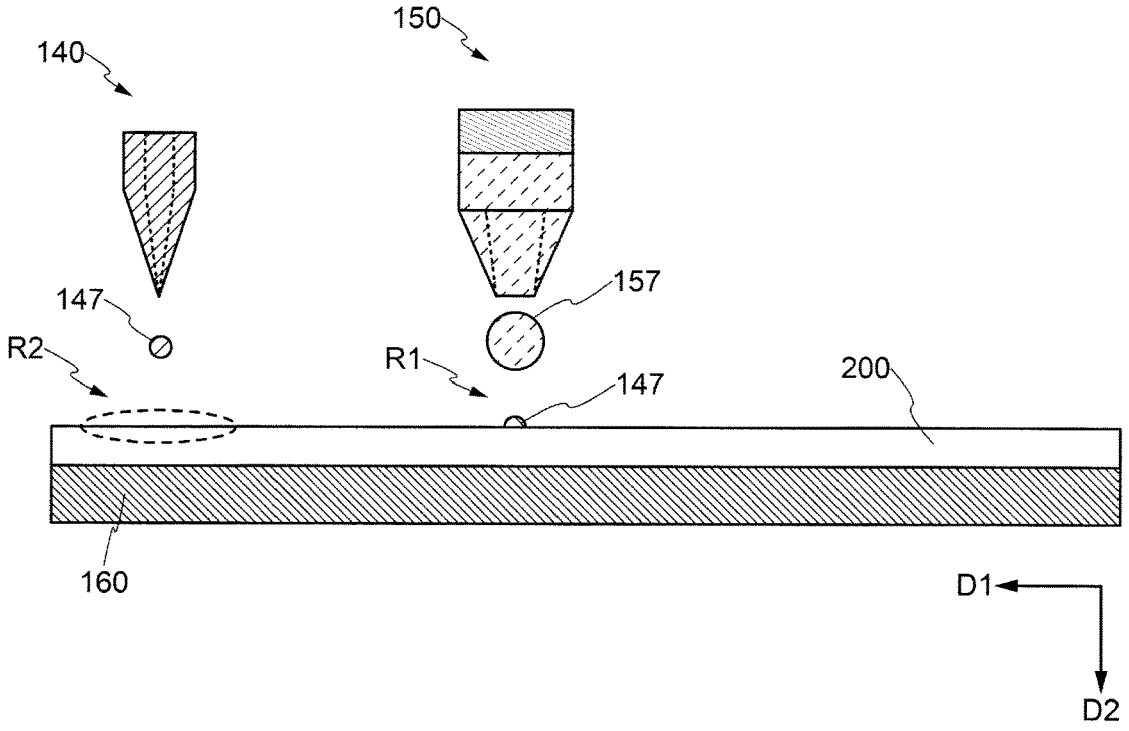
FIG. 5 is a cross-sectional view of a liquid droplet ejection method according to an embodiment of the present disclosure.

Next, as shown in FIG. 5, the first liquid droplet ejection unit 140 ejects the first liquid droplet 147 in the D2 direction onto the second region R2 in the object 200 in the same manner as the first region R1. The second liquid droplet ejection unit 150 ejects the second liquid droplet 157 in the D2 direction onto the first region R1 in synchronization with the first liquid droplet ejection unit 140 ejecting the first liquid droplet 147 onto the second region R2. In this instance, the second liquid droplet ejection unit 150 ejects the second liquid droplet 157 at the same time as the first liquid droplet ejection unit 140 ejects the first liquid droplet 147.

A material with a higher viscosity than the first liquid droplet 147 is used for the second liquid droplet 157.

Specifically, an ink for forming a pattern containing a pigment is used for the second liquid droplet 157. It is desirable that a solvent of the first liquid droplet 147 and a solvent of the second liquid droplet 157 is the same kind of liquid. The first liquid droplet 147 does not contain particles of pigment, and the second liquid droplet 157 may contain particles such as pigment.

Figure 6:
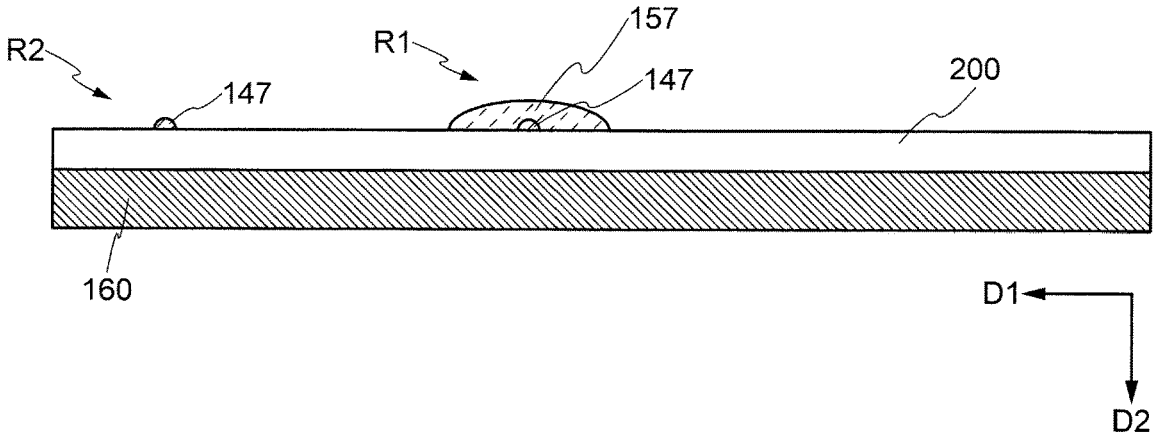
FIG. 6 is a cross-sectional view of a liquid droplet ejection method according to an embodiment of the present disclosure.

In this case, as shown in FIG. 6, a size of the second liquid droplet 157 to be ejected is desirably larger than the size of the first liquid droplet 147. The second droplet 157 may be desirably dispensed so that it is in contact with the first droplet 147. Preferably, the surface of the object 200 has a liquid repellency relative to the second liquid droplet 157.

Figure 7:
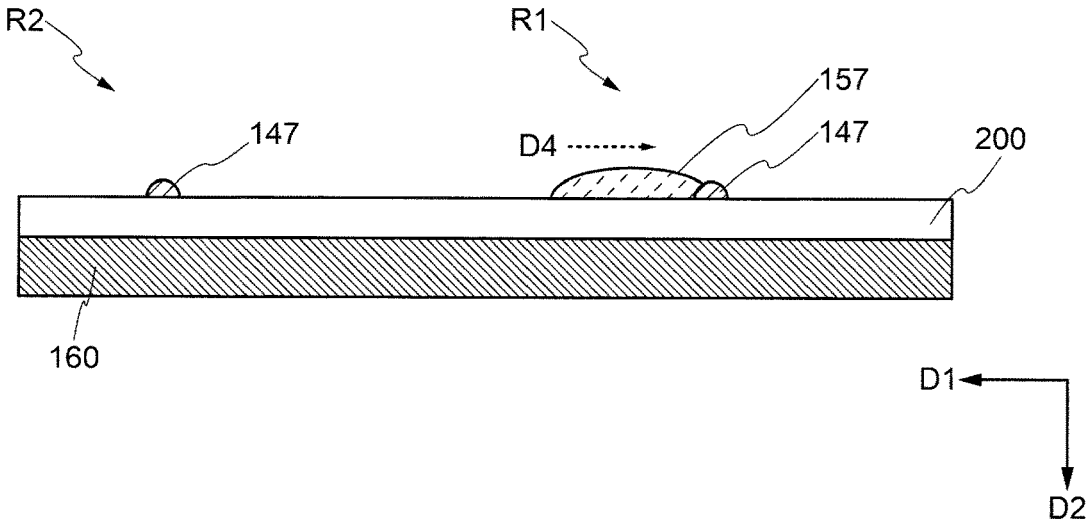
FIG. 7 is a cross-sectional view of a liquid droplet ejection method according to an embodiment of the present disclosure.

FIG. 7 is a cross-sectional view when the second liquid droplet 157 is ejected with shifting from a predetermined position in the first region R1. As shown in FIG. 7, even when the ejection position of the second liquid droplet 157 is ejected with shifting from the predetermined position, the second liquid droplet 157 can be moved and repositioned (realigned) so as to capture the pinned first droplet 147 to minimize the surface-energy when the second liquid droplet 157 is in contact with the first liquid droplet 147. Thereby, even if the ejection position of the second liquid droplet 157 is shifted, the second liquid droplet 157 can be aligned with the target position.

Figure 8:
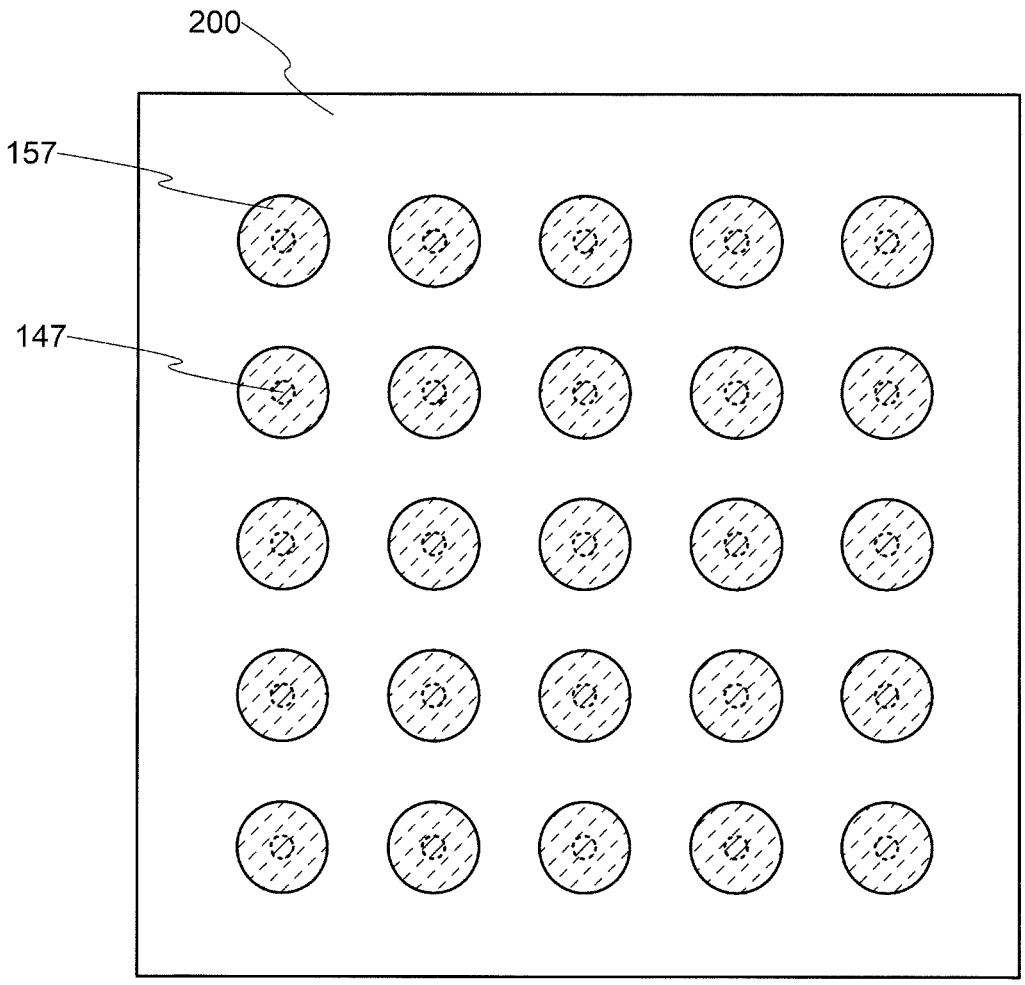
FIG. 8 is a top view of patterns formed by a liquid droplet ejection method according to an embodiment of the present disclosure.

The first liquid droplet ejection unit 140 and the second liquid droplet ejection unit 150 repeat the above processes to perform the desired liquid droplet ejection. FIG. 8 is a top view of the object 200 after liquid droplet ejection. As shown in FIG. 8, patterns (first liquid droplet 147 and second liquid droplet 157) can be placed at a desired location on the object 200.

Here, when comparing the prior art with the present disclosure, in the prior art, it is difficult to form a fine liquid droplet in the piezoelectric inkjet system widely used for industrial use, and there are problems in terms of landing accuracy and resolution. The electrostatic ejection type inkjet system can eject fine liquid droplets and is excellent in position accuracy, resolution, etc., but there is a trade-off between a reduction of tact time, high throughput, and the like.

However, by applying the present embodiment, the second liquid droplet having a large size ejected by the piezo inkjet head is position-controlled by the first liquid droplet that has been landed by controlling the position with high accuracy by the electrostatic ejection type inkjet. That is, by applying the present embodiment, it is possible to achieve both high definition, high precision, and high productivity.

By applying this embodiment, a particle-free solvent is ejected from the electrostatic ejection type inkjet head as the first liquid droplet. The liquid (ink) having particles for patterning is ejected from a piezo-type inkjet head having an inner diameter larger than the inner diameter of the tip in the electrostatic ejection type inkjet nozzle. Therefore, it is possible to prevent clogging of the inkjet nozzle caused by the particle (solid product).

Second Embodiment

In the present embodiment, examples in which a step 170 is provided on the surface of the object 200 will be described with reference to the drawings.

First, the first liquid droplet ejection unit 140 and the second liquid droplet ejection unit 150 move on the object 200 having the structure 170 by the driving unit 130. The structure 170 (also referred to as a pattern or a structure) on the surface of the object 200 is provided as an organic insulating layer. The organic insulating layer used for the structure 170 is not particularly limited, but in this example, a polyimide resin is used for the structure 170. The structure 170 may be made of other organic resins such as acrylic resin, epoxy resin, or inorganic materials such as silicon oxide ($SiO_x$), silicon nitride ($SiN_x$), aluminum oxide ($AlO_x$), or the like. In this embodiment, the structure 170 is provided in the shape of a grid so as to expose a part of the surface in the object 200. Therefore, each of the first region R1 and the second region R2 from which the first liquid droplet 147 and the second liquid droplet 157 are ejected is surrounded by the structure 170. In this embodiment, it is preferable that the surface of the object 200 has a lyophilic and the surface of the structure 170 has a liquid repellency. Therefore, it is desirable to appropriately select an optimum material for the object 200.

Figure 9:
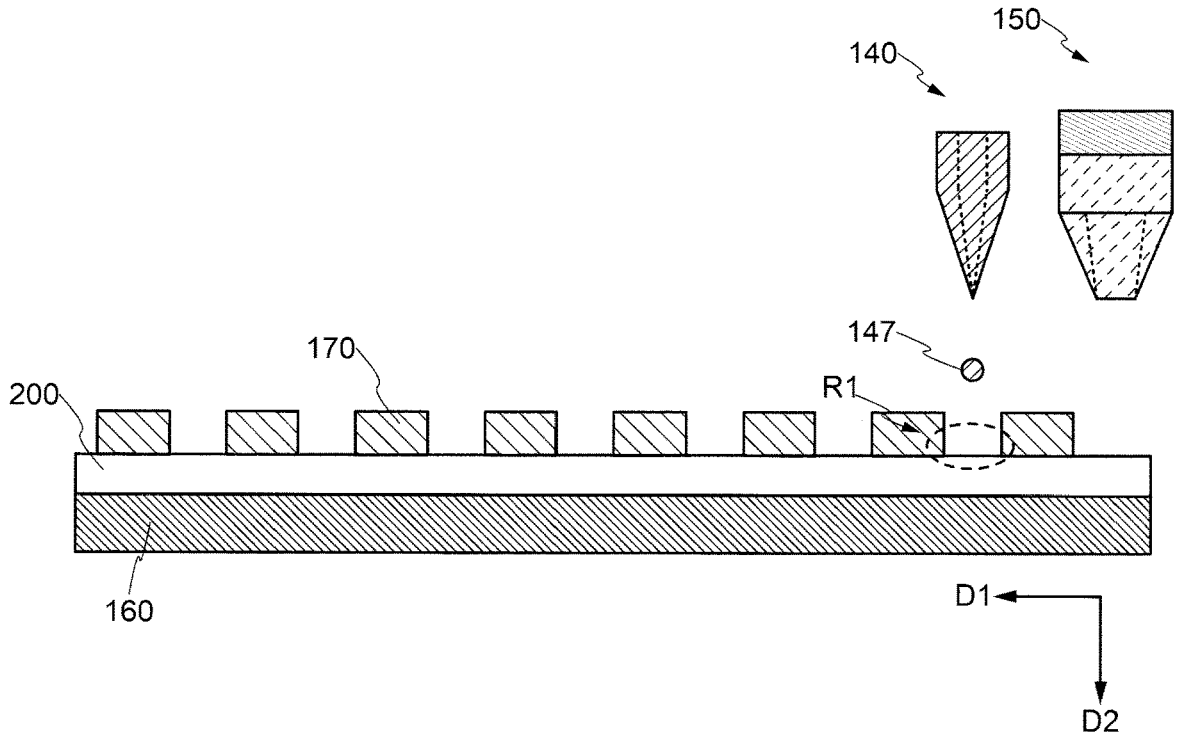
FIG. 9 is a cross-sectional view of a liquid droplet ejection method according to an embodiment of the present disclosure.
Figure 10:
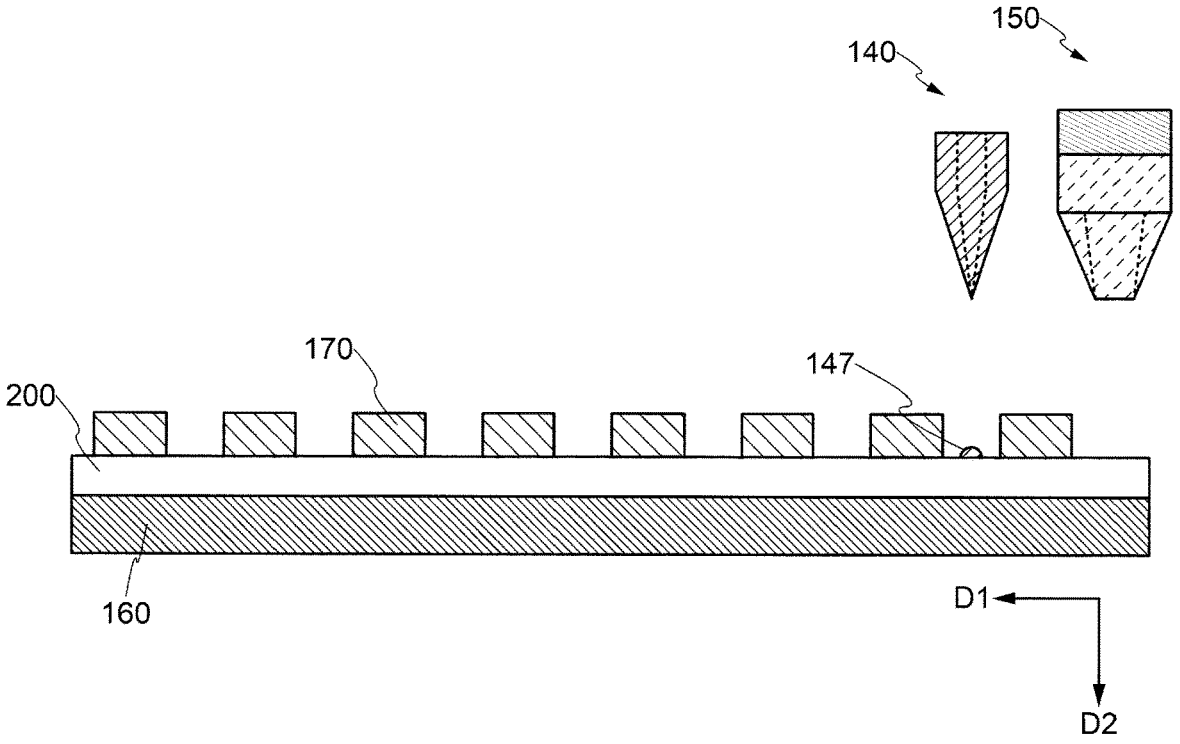
FIG. 10 is a cross-sectional view of a liquid droplet ejection method according to an embodiment of the present disclosure.

As shown in FIG. 9, the first liquid droplet ejection unit 140 is arranged on the first region R1. The first liquid droplet ejection unit 140 ejects the first liquid droplet 147 onto the first region R1. As shown in FIG. 10, the first liquid droplet 147 lands on a first region R1 (more specifically, a preset position in the first region R1) on the surface of the object 200.

It is desirable that the first liquid droplet 147 landed on the object 200 is treated with the pinning process. Thus, at least a portion of the first liquid droplet 147 is fixed onto the object 200. Before ejecting the first liquid droplet 147, the surface of the object 200 may be pretreated. Thus, the wettability of the object 200 is improved, and the object 200 can have a lyophilic for the first liquid droplet 147.

Figure 11:
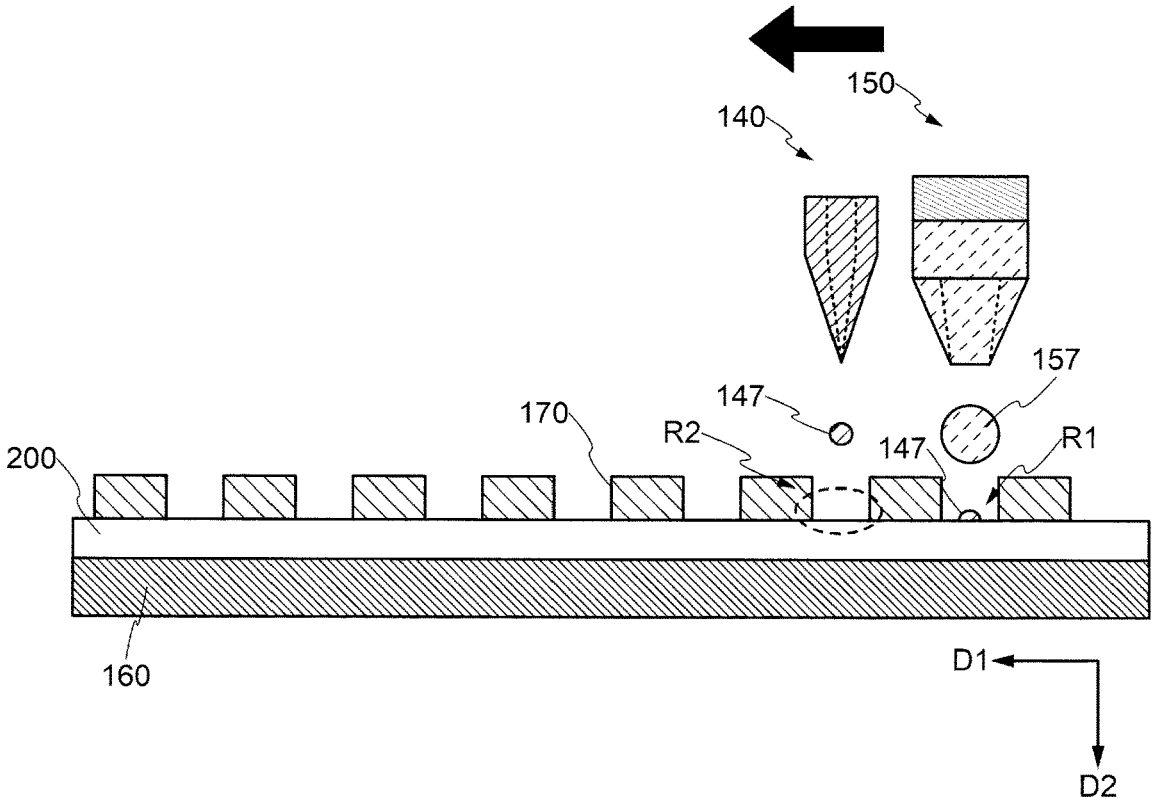
FIG. 11 is a cross-sectional view of a liquid droplet ejection method according to an embodiment of the present disclosure.

Next, as shown in FIG. 11, the first liquid droplet ejection unit 140 moves from the first region R1 to the second region R2 on the object 200. The second liquid droplet ejection unit 150 moves onto the first region R1 where the first liquid droplet 147 was ejected. Like the first region R1, the first liquid droplet ejection unit 140 ejects the first liquid droplet 147 onto the second region R2 of the object 200. The second liquid droplet ejection unit 150 ejects the second liquid droplet 157 onto the first region R1 in synchronization with the first liquid droplet ejection unit 140 ejecting the first liquid droplet 147 to the second region R2. In this instance, the second liquid droplet ejection unit 150 ejects the second liquid droplet 157 at the same time as the first liquid droplet ejection unit 140 ejects the first liquid droplet. At this time, it is desirable that the second liquid droplet 157 is ejected so as to be in contact with the first liquid droplet 147.

Figure 12:
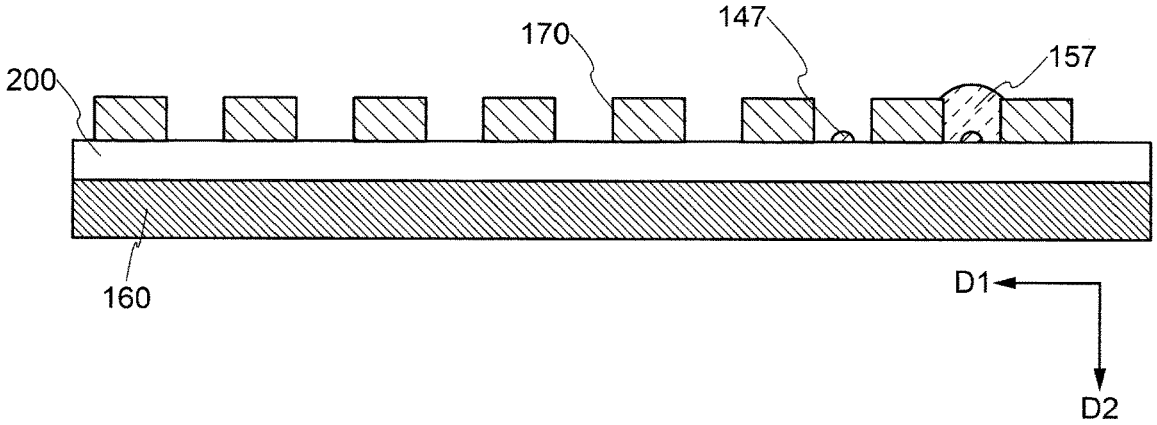
FIG. 12 is a cross-sectional view of a liquid droplet ejection method according to an embodiment of the present disclosure.
Figure 13:
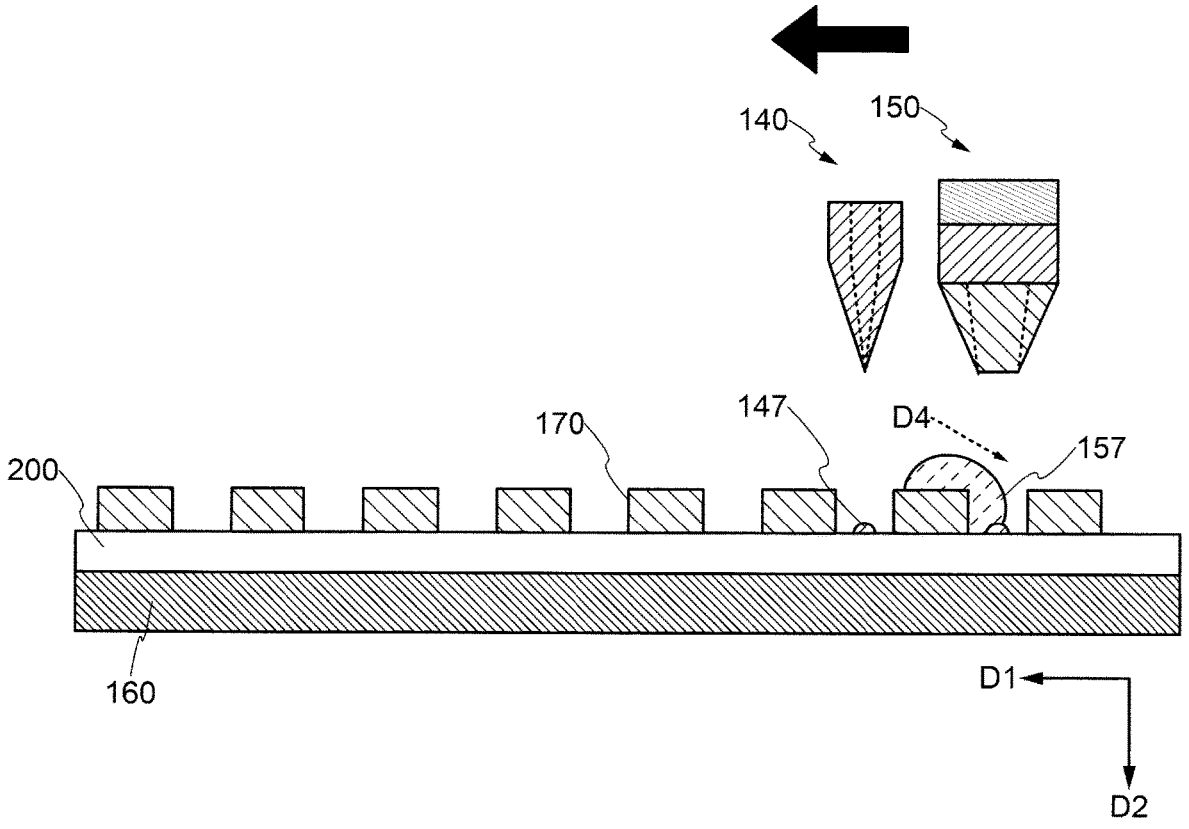
FIG. 13 is a cross-sectional view of a liquid droplet ejection method according to an embodiment of the present disclosure.

When the second liquid droplet 157 is ejected at a predetermined position, as shown in FIG. 12, the second liquid droplet 157 lands on the surface of the object 200 inside the parallel cross structure provided in the structure 170. On the other hand, as shown in FIG. 13, the second liquid droplet 157 may be ejected out of position. In this instance, when the second liquid droplet 157 contacts the first liquid droplet 147, a portion which is present on the structure 170 among the second liquid droplet 157 moves to the object 200, and the position of the entire second liquid droplet 157 changes (re-alignment) so as to capture the pinning-processed first liquid droplet 147 in order to minimize the surface energy. Thus, even when the eject position of the second liquid droplet 157 is shifted, the second liquid droplet 157 can be aligned with the target position. This phenomenon is effective when the surface of the object 200 is lyophilic and the surface of the structure is liquid repellency, so that the second liquid droplet 157 is easily moved.

Figure 14:
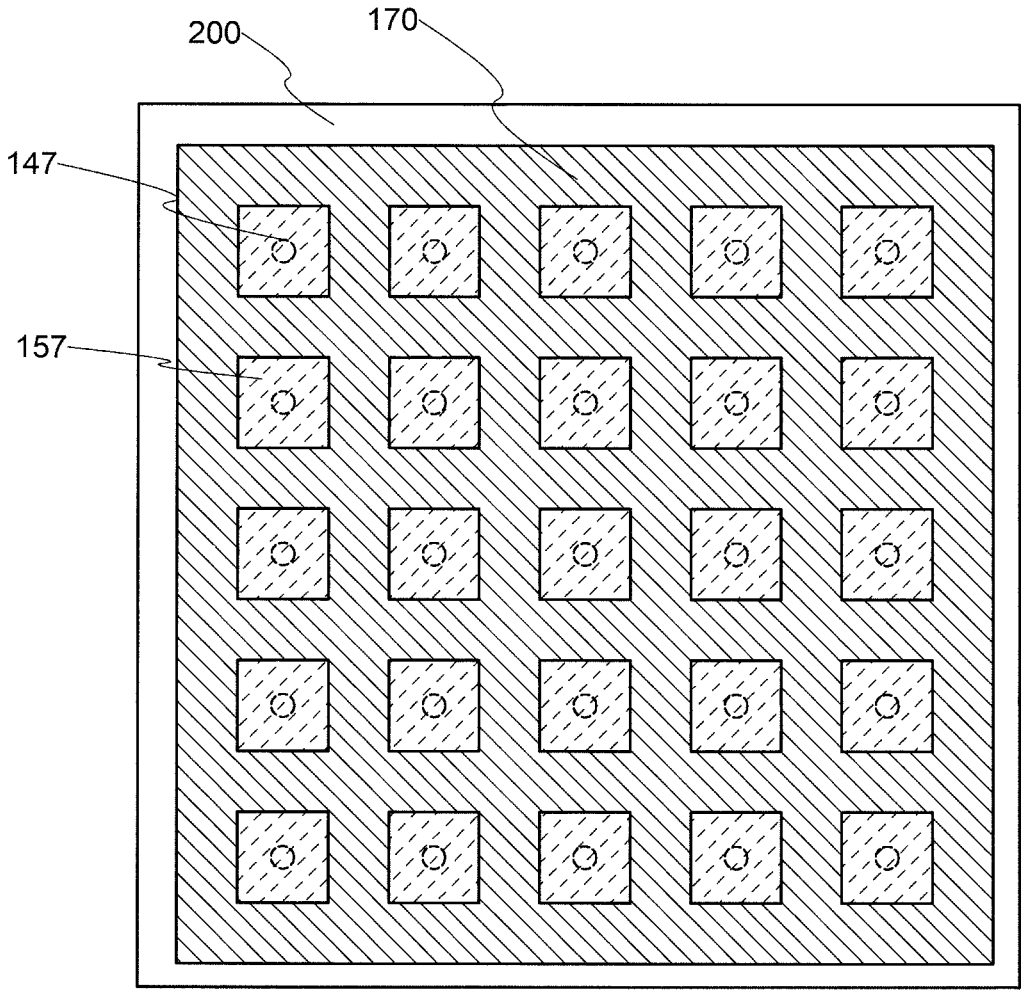
FIG. 14 is a top view of patterns formed by a liquid droplet ejection method according to an embodiment of the present disclosure.

The first liquid droplet ejection unit 140 and the second liquid droplet ejection unit 150 repeat the above-described process, and as shown in FIG. 14, the first liquid droplet 147 and the second liquid droplet 157 are provided on the surface of the object 200, rather than on the structure 170.

Third Embodiment

In the present embodiment, a liquid droplet ejection device differing from the first embodiment will be described. Specifically, an example in which a liquid droplet ejection device includes a plurality of first liquid droplet nozzles 141 and a plurality of second liquid droplet nozzles 151 will be described. For the sake of explanation, members thereof will be omitted as appropriate.

3-1. Configuration of the Liquid Droplet Ejection Device 100A

Figure 15:
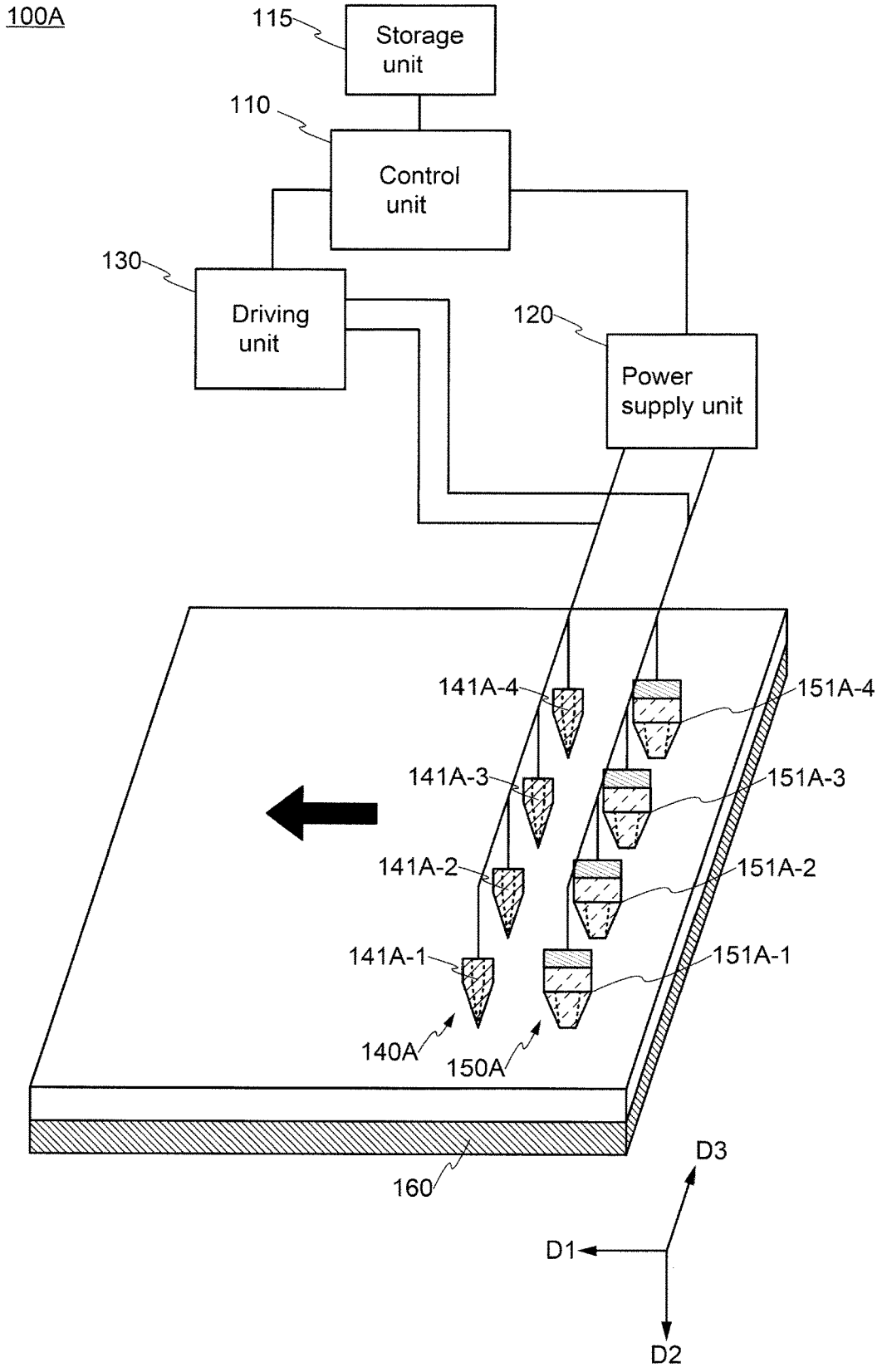
FIG. 15 is a schematic view of a liquid droplet ejection device according to an embodiment of the present disclosure.

FIG. 15 is a schematic view of a liquid droplet ejection device 100A according to an embodiment of the present disclosure. The liquid droplet ejection device 100A includes the control unit 110, the storage unit 115, the power supply unit 120, the driving unit 130, a first liquid droplet ejection unit 140A, and a second liquid droplet ejection unit 150A.

In the present embodiment, the first liquid droplet ejection units 140A includes a plurality of first liquid droplet ejection units arranged in a direction (specifically, D3 the direction orthogonal to the D1 direction) intersecting with respect to the direction (in this case, the D1 direction) in which the first liquid droplet ejection unit 140A moves (specifically, the first liquid droplet ejection unit 140A includes a first liquid droplet nozzle 141A-1, 141A-2, 141A-3, and 141A-4 arranged independently). Similarly, the second liquid droplet ejection units 150A includes a plurality of second liquid droplet ejection units arranged in a direction intersecting the direction in which the second liquid droplet ejection unit 150A moves (more specifically, the second liquid droplet ejection unit 150A includes a second liquid droplet nozzle 151A-1, 151A-2, 151A-3, and 151A-4 each arranged independently). In the present embodiment, by having the first liquid droplet ejection unit 140A and the second liquid droplet ejection unit 150A, the process duration of the liquid droplet ejection can be shortened.

Figure 16:
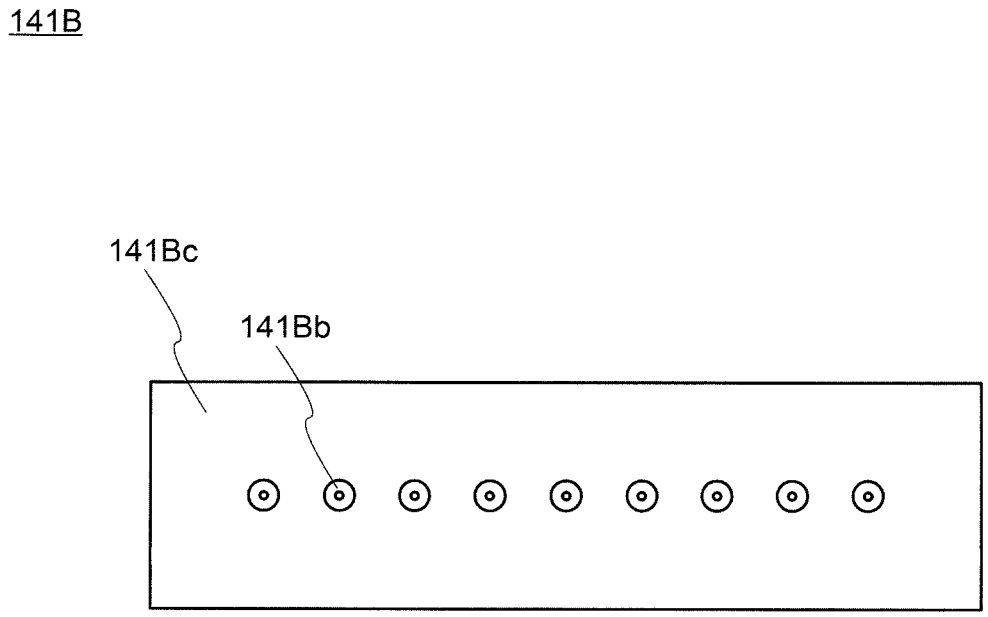
FIG. 16 is a top view of a second liquid droplet nozzle according to an embodiment of the present disclosure.
Figure 17A:
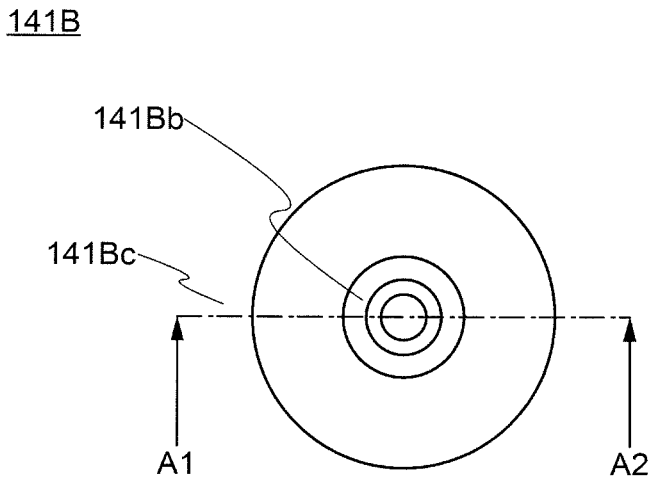
FIG. 17A is an enlarged top view of a portion in a second liquid droplet nozzle according to an embodiment of the present disclosure.
Figure 17B:
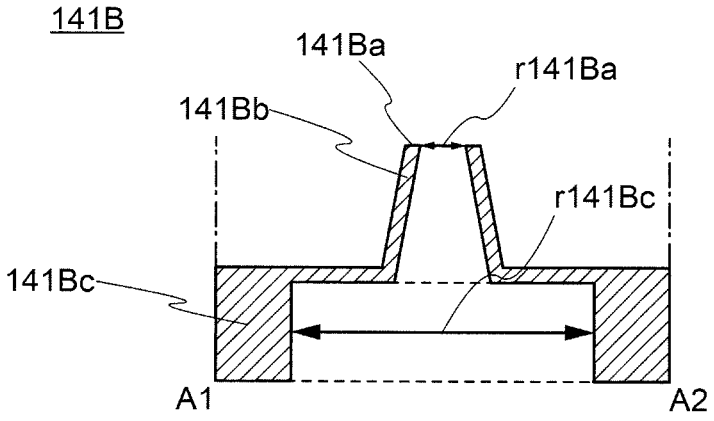
FIG. 17B is a cross-sectional view of a portion of a second liquid droplet nozzle according to an embodiment of the present disclosure.

In the present embodiment, an example in which a plurality of first liquid droplet nozzle 141A is independently provided in the first liquid droplet ejection unit 140A is shown, but the present disclosure is not limited thereto. FIG. 16 is a top view of the first liquid droplet nozzle 141B. FIG. 17A is an enlarged top view of a portion of the first liquid droplet nozzle 141B. FIG. 17B is a cross-sectional view of a portion of the first liquid droplet nozzle 141B. As shown in FIGS. 16 and 17A, and 17B, the first liquid droplet nozzle 141B has a plurality of nozzle units 141Bb and a plate unit 141Bc. In this example, the plurality of nozzle units 141Bb are arranged in a row, but may be arranged in a plurality of rows.

A metal material such as nickel is used for the nozzle unit 141Bb. The nozzle unit 141Bb is formed to be tapered by, for example, an electroforming process. A metal material such as stainless steel is used for the plate unit 141Bc. The plate unit 141Bc has a hole having an inner diameter r141Bc larger than the inner diameter r141Ba of the ejection port (nozzle tip 141Ba) in the nozzle unit 141Bb in a portion overlapping with the nozzle unit 141Bb. The nozzle unit 141Bb may be welded to the plate unit 141Bc or may be fixed by an adhesive. When the first liquid droplet nozzle 141B is used, a voltage may be applied to the nozzle 141Bb, or a voltage may be applied to the plate unit 141Bc (or the first ink tank 143).

A person of ordinary skill in the art would readily conceive various alterations or modifications of the present disclosure, and such alterations and modifications are construed as being encompassed in the scope of the present disclosure. For example, the devices in the above-described embodiments may have an element added thereto, or deleted therefrom, or may be changed in design optionally by a person of ordinary skill in the art. The methods in the above-described embodiments may have a step added thereto, or deleted therefrom, or may be changed in the condition optionally by a person of ordinary skill in the art. Such devices and methods are encompassed in the scope of the present disclosure as long as including the gist of the present disclosure.

Modification

In the first embodiment of the present disclosure, an example in which the first liquid droplet ejection unit 140 and the second liquid droplet ejection unit 150 move on the object 200 by the driving unit 130 is shown, but the present disclosure is not limited thereto. For example, in the liquid droplet ejection device, the driving unit 130 may move the object 200. In this instance, the first liquid droplet ejection unit 140 and the second liquid droplet ejection unit 150 may be respectively fixed in place.

In the first embodiment of the present disclosure, an example in which the first liquid droplet nozzle 141 is provided perpendicularly to the surface of the object 200 is shown, but the present disclosure is not limited thereto. The first liquid droplet nozzle 141 may have an inclination with respect to the direction perpendicular to the object 200. The same shape may apply to the second liquid droplet nozzle 151 of the second liquid droplet ejection unit 150.

In the first embodiment of the present disclosure, an example in which an organic insulating layer is used as the structure is shown, but the present disclosure is not limited thereto. For example, the structure 170 may be a wiring pattern or an inorganic material may be used. The object 200 itself may be fabricated to provide a structure. The object 200 may be a wiring substrate in which a wiring is laminated.

When the first liquid droplet 147 is ejected in the first embodiment of the present disclosure, an image may be taken by using an imaging device. In this instance, the imaging result may be determined by the control unit 110. When the control unit 110 determines that there is an ejection failure of the first liquid droplet 147, the control unit 110 may control so as not to eject the second liquid droplet 157 in response to the failure generation region. After the liquid droplet ejection process of the entire object is completed, the first liquid droplet 147 and the second liquid droplet 157 may be ejected into the ejection failure generation region. As a result, it is possible to suppress the liquid droplet ejection failure.

In the first embodiment of the present disclosure, an example in which the second liquid droplet 157 is ejected to be in contact with the first liquid droplet 147 has been described, but the present disclosure is not limited thereto. For example, the second liquid droplet 157 is also applicable when the second liquid droplet 157 is ejected close to the first liquid droplet 147.

In the first embodiment of the present disclosure, an example in which the electrostatic ejection type nozzle is used for the first liquid droplet nozzle 141 is shown, but the present disclosure is not limited thereto. When a position control is possible, a piezo-type inkjet nozzle may be used for the first liquid droplet nozzle 141.

In the first embodiment of the present disclosure, an example in which the pinning process is performed using a light is shown, but the present disclosure is not limited thereto. For example, the pinning process may be performed using heat. When the pinning process by light or heat is not performed, an aqueous solution containing a metallic salt may be used for the first liquid droplet 147. Calcium salts, sodium salts, or the like are used for the metal salt. By including the metal salt in the first liquid droplet, the metal salt is deposited when the moisture of the first liquid droplet evaporates, thereby enhancing the pinning property.

The invention claimed is:

1. A liquid droplet ejection device comprising:

at least one first liquid droplet ejection unit including a first liquid holding unit and a first tip, the first liquid holding unit being configured to hold a first liquid, and the first tip being configured to eject the first liquid as a first liquid droplet onto an object;

at least one second liquid droplet ejection unit including a second liquid holding unit and a second tip, the second liquid holding unit being configured to hold a second liquid, and the second tip being configured to eject the second liquid as a second liquid droplet having different characteristics from the first liquid droplet onto the object;

an object holding unit configured to hold the object onto which the first liquid and the second liquid are ejected; and a driving unit configured to move the first tip and the second tip in a first direction relative to the object holding unit, wherein an inner diameter of the second tip is larger than an inner diameter of the first tip, the first tip and the second tip are arranged along the first direction, the second tip is arranged behind the first tip, the at least one first liquid droplet ejection unit has an electrostatic ejection type nozzle head, and the at least one second liquid droplet ejection unit has a piezo type nozzle head.

2. The liquid droplet ejection device according to claim 1, wherein an ejection amount of the second liquid droplet by the at least one second liquid droplet ejection unit per unit time is more than an ejection amount of the first liquid droplet by the at least one first liquid droplet ejection unit per unit time.

3. The liquid droplet ejection device according to claim 1, wherein the at least one first liquid droplet ejection unit includes a plurality of first liquid droplet ejection units provided in the direction intersecting the first direction, and the at least one second liquid droplet ejection unit includes a plurality of second liquid droplet ejection units provided in the direction intersecting the first direction.

4. A liquid droplet ejection method comprising:

ejecting a first liquid droplet onto a first region of an object;

ejecting a second liquid droplet having different characteristics from the first liquid droplet with second ejection amount more than first ejection amount of the first liquid droplet onto the first region so as to be contacted with the ejected first liquid droplet; and ejecting the first liquid droplet onto a second region different from the first region in synchronization with ejecting the second liquid droplet into the first region, wherein;

the first liquid droplet is ejected from an electrostatic ejection type nozzle head, and the second liquid droplet is ejected from a piezo type nozzle head.

5. The liquid droplet ejection method according to claim 4, wherein at least a part of the first liquid droplet is fixed to the object before the second ejected droplet is ejected.

6. The liquid droplet ejection method according to claim 4, wherein a size of the ejected first liquid droplet is 100 nm or more and 500 μm or less.

7. The liquid droplet ejection method according to claim 4, wherein a solvent of the first liquid droplet and a solvent of the second liquid droplet are the same kind of liquid.

8. The liquid droplet ejection method according to claim 4, wherein the first liquid droplet does not include particles, and the second liquid droplet includes particles.

9. The liquid droplet ejection method according to claim 4, wherein a structure is provided on the object so as to surround each of the first region and the second region of the object, a surface of the object has a lipophilic property, and a surface of the structure has liquid repellent property.

* * * * *